US010470523B2

(12) United States Patent
Creton

(10) Patent No.: US 10,470,523 B2
(45) Date of Patent: Nov. 12, 2019

(54) SHOELACE COMPRISING A SILICONE BAND

(71) Applicants: Sylvain Creton, Hyeres (FR); Sylvie Trinel, Hyeres (FR)

(72) Inventor: Sylvain Creton, Hyeres (FR)

(73) Assignees: Sylvie Trinel, Hyeres (FR); Sylvain Creton, Hyeres (FR)

( * ) Notice: Subject to any disclaimer, the term of this patent is extended or adjusted under 35 U.S.C. 154(b) by 95 days.

(21) Appl. No.: 15/522,900

(22) PCT Filed: Oct. 28, 2015

(86) PCT No.: PCT/FR2015/052904

§ 371 (c)(1),
(2) Date: Apr. 28, 2017

(87) PCT Pub. No.: WO2016/066959

PCT Pub. Date: May 6, 2016

(65) Prior Publication Data

US 2017/0318907 A1 Nov. 9, 2017

(30) Foreign Application Priority Data

Oct. 28, 2014 (FR) ..... 14 02457

(51) Int. Cl.
*A43C 9/00* (2006.01)
*A43C 1/02* (2006.01)

(52) U.S. Cl.
CPC . *A43C 1/02* (2013.01); *A43C 9/00* (2013.01)

(58) Field of Classification Search
CPC ..... A43C 1/02; A43C 9/00
See application file for complete search history.

(56) References Cited

U.S. PATENT DOCUMENTS 696,440 A 4/1902 Holland
931,949 A * 8/1909 Morrow ..... A43C 7/00 24/712
2,141,801 A * 12/1938 Taft ..... A43C 9/00 24/713

(Continued)

OTHER PUBLICATIONS

International Search Report dated Jul. 8, 2016 re: Application No. PCT/FR2015/052904; pp. 1-2; citing: US 2006/168785 A1, U.S. Pat. No. 696,440 A and US 2004/237348 A1.

*Primary Examiner* — Jason W San
(74) *Attorney, Agent, or Firm* — Cantor Colburn LLP

(57) ABSTRACT

A lace (200) for a shoe (C), consisting of an elongate elastic band (2) made entirely of silicone, said band having elastic properties according to which, when at least one segment of said band is selected, said segment having a constant cross-section and a rest length of 5.0 centimeters, when said segment is stretched to a stretched length of 10.0 centimeters and then released, said segment contracts and reaches a first released length of between 5.6 and 7.0 centimeters after a first period of between 0.1 and 1 second after the release, and reaches a second released length of between 5.0 and 5.6 centimeters after a second period of between 15 and 25 seconds after the release. The invention is particularly applicable in the field of sports shoes, and in particular running shoes, to prevent any compression and thus allow good blood circulation while holding the foot comfortably.

19 Claims, 5 Drawing Sheets

(56) References Cited

U.S. PATENT DOCUMENTS 2,306,515 A * 12/1942 Wright ..... A43C 9/00 24/713
2,477,151 A * 7/1949 Stapleton ..... A43C 9/00 24/713
5,111,558 A * 5/1992 Ridley ..... A43C 9/00 24/300
D406,692 S * 3/1999 Shin ..... D2/978
5,946,779 A * 9/1999 Chen ..... A43C 9/00 24/712
6,513,210 B1 * 2/2003 Gonzalez ..... A43C 1/00 24/300
7,798,155 B2 * 9/2010 Schweers ..... A42C 5/00 132/273
8,523,932 B2 * 9/2013 Roeder ..... A61F 2/07 623/1.11
8,931,146 B2 * 1/2015 Stanev ..... A43C 1/02 24/712
9,955,754 B2 * 5/2018 Liu ..... A43C 9/00
2004/0237348 A1 12/2004 Lacey
2005/0125971 A1 * 6/2005 Lee ..... A43C 9/00 24/712
2005/0217089 A1 * 10/2005 Lin ..... A43C 9/00 24/712
2005/0260550 A1 * 11/2005 Wilk ..... A43B 1/0027 434/260
2006/0168785 A1 * 8/2006 Kraft ..... A43C 1/02 24/715.3
2006/0277728 A1 * 12/2006 Ho ..... A43C 9/00 24/713.1
2012/0232655 A1 * 9/2012 Lorrison ..... A61F 2/0045 623/13.19
2013/0255045 A1 * 10/2013 Gonzalez ..... A43C 9/00 24/715.3
2014/0007392 A1 * 1/2014 Kajiwara ..... A43C 9/00 24/715.3
2014/0215777 A1 * 8/2014 Lee ..... A43C 1/02 24/713
2015/0128389 A1 * 5/2015 Carney ..... A43C 9/00 24/715.7
2016/0270481 A1 * 9/2016 Harden ..... A43B 1/0054
2017/0065026 A1 * 3/2017 Wu ..... A43C 1/02
2017/0251763 A1 * 9/2017 Liu ..... A43C 9/00
2017/0367442 A1 * 12/2017 Tsai ..... A43C 9/02
2018/0116341 A1 * 5/2018 Cogliandro ..... A43C 9/00
2018/0140051 A1 * 5/2018 Jugeau ..... A43C 1/02

* cited by examiner

Fig.1
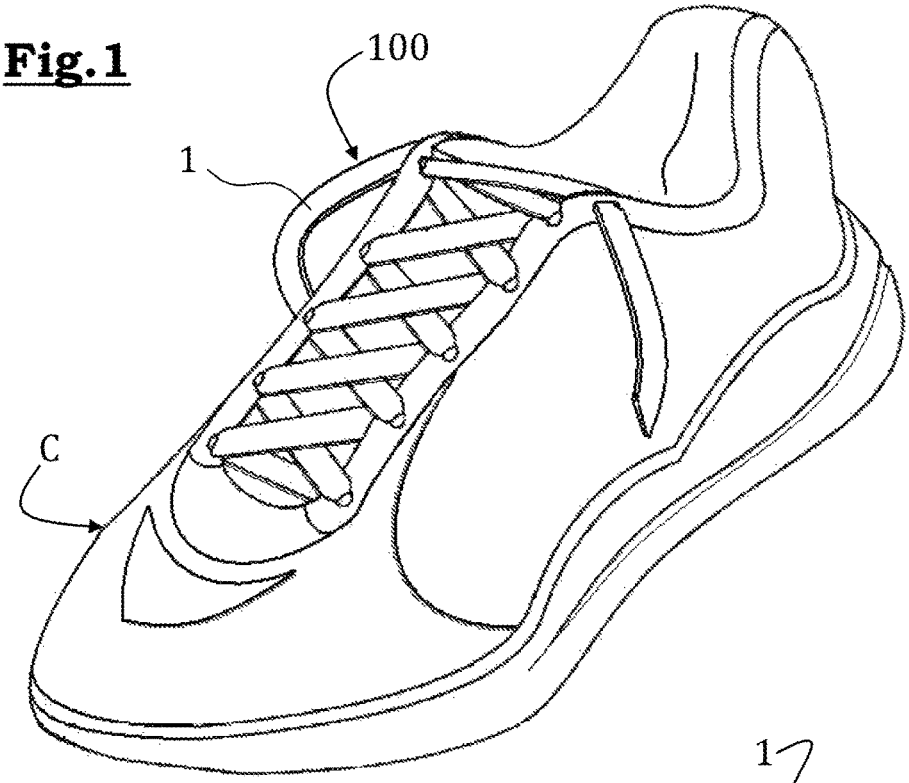
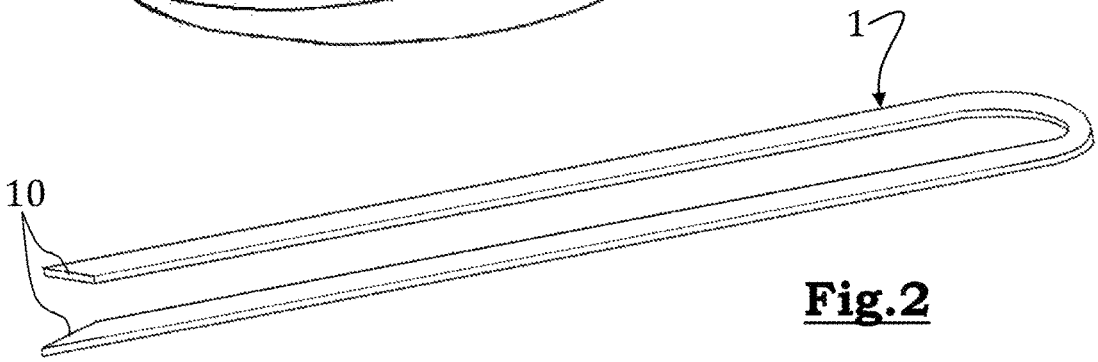
Fig.2
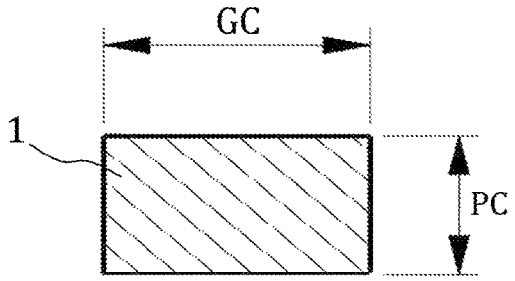
Fig.3

SHOELACE COMPRISING A SILICONE BAND

TECHNICAL FIELD

The present invention relates to a shoelace.

The shoelace in accordance with the invention finds a preferred application in the field of lace-up shoes, in particular sport shoes, and in particular running shoes, including nature or trail race shoes, and walking shoes, and may also be considered for city shoes, safety shoes, climbing shoes, etc.

BACKGROUND OF THE INVENTION

Whether in the context of a sport practice or of a daily use, people tend to tighten the shoelaces of their shoes too much in particular in order to feel an accentuate holding of the foot. Furthermore, during a physical effort, such as running or walking, the foot swells naturally inside the shoe, by blood inflow, and the foot therefore becomes tightened too much by the shoelace.

Still, shoelaces tightened too much on a foot, whether because of a too strong initial tightening or because of a subsequent swelling of the foot, result in numerous annoyances.

The compression of the foot by a shoelace tightened too much may result in a compression of the blood and nerve vessels, with several negative consequences: heavy legs sensations, pins and needles sensations, tingling, pains at the calves, cramps, tears, sprains or contractures.

Furthermore, a shoelace tightened too much also prevents the foot arches from moving freely and results in hindering the movement of the foot during an activity.

In addition, a too tightened shoelace tends to rigidify the shoe, with as a potential consequence a Morton neuroma. This neuroma, also called the «Morton's disease», is a very painful affection which touches the interdigital nerve of the foot because of a too tightened foot.

In the shoelaces field are known the fabric-made shoelaces, for example made of polyester, nylon, cotton or linen, as known from the document U.S. Pat. No. 696,440, and the rubber-made shoelaces.

The first example of a fabric-made shoelace barely offers comfort for the foot. Indeed, throughout the day, or during a sport activity, the pressure of the foot increases, and the rigidity of the shoelace will make its support unpleasant and above all generating compression marks on the top-side of the foot, called the «instep».

The second example of a rubber-made shoelace has the drawback of compressing the foot too strongly because of a too high elastic return. Indeed, because of its elasticity, the carrier will tend to tighten too much his rubber-made shoelaces which will strongly compress the foot in the shoe.

The state of the art is also illustrated by the teaching of document U.S. 2006/0168785 which discloses a shoelace comprising an elastic core, in particular made of silicone, wrapped inside with a sheath made of a plastic material, paper, a fabric or elastic, and a friction element associated to the sheath. Particularly because of the presence of the sheath and the friction element, this shoelace has the same defects as the two aforementioned shoelaces, and thus does not offers comfort and holding adapted to avoid the problems of over-compression of the foot.

SUMMARY OF THE INVENTION

The disclosure provides a shoelace which takes into account the change of pressure of a foot when in activity in order to avoid any compression and thus to allow a good blood flow while comfortably holding the foot and offering an unrivaled comfort.

To this end, it proposes a shoelace for a shoe, of the type constituted by an elongate elastic band entirely made of silicone, said band having elastic properties according to which, by selecting at least one segment of said band, said segment having a constant cross-section and a length at rest of 5.0 centimeters, when said segment is stretched until reaching a stretched length of 10.0 centimeters and then released, said segment contracts and reaches a first released length comprised between 5.6 and 7.0 centimeters after a first time comprised between 0.1 and 1 second after the release, and reaches a second released length comprised between 5.0 and 5.6 centimeters after a second time comprised between 15 and 25 seconds after the release.

Thus, the invention is based on a shoelace comprising a silicone-made band having particular elastic return properties; these elastic properties depending on the transverse dimensions of the silicone-made band and of the selected silicone material. In other words, the band has transverse dimensions and is made of a silicone material selected so that the band has the elastic return properties defined hereinabove.

The Applicant has observed that such elastic properties guarantee a tensioned lacing, strongly held or pleasantly held, but never tightened so much that the foot is compressed. Thanks to such a silicone-made band, regardless of the tension, the silicone-made band of the shoelace will always offer an optimum and pleasant comfort which will keep still.

Furthermore, the silicone has a self-gripping character (by friction) which advantageously allows the knot and the loop to remain held and not be untied on their own, thereby avoiding an unexpected opening of the knot which would result in a fall. This self-gripping particularity also allows that the foot will always remain held, even with a broken portion of the shoelace.

Advantageously, the silicone-made band may be cut to the proper length, in order not to have too long shoelace and loops.

For more information, when the concerned segment is stretched until reaching a stretched length of 10.0 centimeters, this stretching is performed at a stretching speed comprised between 1.0 and 2.0 centimeters per second, and in particular between 1.2 and 1.6 centimeters per second.

For comparison, a conventional rubber-made shoelace which undergoes the above-described stretching/release test, has a released length of about 5.0 centimeters, namely a return to its initial length, after a time comprised between 0.1 and 1 second.

Another advantage of silicone is its resistance to the ultraviolet radiations of the solar radiation and also to thermal shocks, not to mention that this silicone-made band will not freeze below −40° C., and will always prove effective. According to a first embodiment, the band has a constant cross-section over at least 95% of its length, and in particular over substantially its entire length.

Such a band with a regular or almost regular cross-section over the entire length of the band, allows an easy manufacturing, in particular by injection.

In this first embodiment, the band advantageously has a first released length comprised between 6.6 and 7.0 centimeters, and a second released length comprised between 5.3 and 5.6 centimeters; these data being of course to be related with the aforementioned modus operandi in which, there is selected at least one segment having a length at rest of 5.0 centimeters, which is stretched until reaching a stretched length of 10.0 centimeters and then released.

According to a second embodiment, the band has at least three successive elongate sections comprising a section called central section surrounded by two sections called intermediate sections with the same lengths, the intermediate sections having the same constant cross-section over their entire respective lengths, and the central section having a cross-section constant over its entire length and different from the cross-section of the intermediate sections, where the central section has a first released length and a second released length greater than respectively the first released length and the second released length of the intermediate sections.

Thus, once laced in a conventional, and therefore symmetrical, manner, the central section is positioned at the start (or at the bottom) of the lacing area, then the two intermediate sections prolong the central section to the right and to the left, upwards, for a lacing at the instep; the central section having a elastic return weaker (in other words less rapid) than the two intermediate sections, a high or strong—or even rapid—elastic return reflecting a high capacity to rapidly return to the initial state, that is to say to rest. Thus, the two intermediate sections have a stronger (in other words more rapid) elastic return in order to guarantee a good holding at the instep, whereas the central section has a weaker (in other words less rapid) elastic return for a more firm lacing base.

In this manner, this band offers at least two distinct elasticity areas to the shoelace, with a lower area at the bottom of the shoelace (the central section) and an intermediate area at the instep (the intermediate sections).

In general, each section has a length of at least 100 millimeters, or even at least 150 millimeters, in order that each section fully participates in lacing with its own elastic properties, either at the start of the lacing (at the instep), or at the end of the lacing (at the lacing knot). In other words, these sections do not constitute artifices or aesthetic elements which do not act on the lacing. Similarly, the ratio between the length of the central section and the length of an intermediate section is greater than or equal to 0.8.

According to one possibility of the invention, the central section has a first released length comprised between 6.2 and 6.6 centimeters and a second released length comprised between 5.4 and 5.6 centimeters, and each intermediate section has a first released length comprised between 5.9 and 6.3 centimeters and a second released length comprised between 5.1 and 5.3 centimeters.

These values meet particularly well the expectations in terms of holding and comfort, though without compressing the foot.

According to another possibility, the central section has a substantially ellipsoidal cross-section having a major axis and a minor axis, and each intermediate section has a substantially rectangular cross-section having a long-side edge parallel to said major axis and a short-side edge parallel to said minor axis, where said minor axis is larger than said short-side edge and said major axis is substantially equivalent to said long-side edge.

Such a geometric shaping allows meeting the aforementioned requirements in terms of the elastic return, namely a central section having an elastic return weaker than the two intermediate sections.

According to one feature, the ratio between the length of the central section and the length of an intermediate section is comprised between 0.8 and 1.25.

Advantageously, the band has two sections called end sections with the same lengths and prolonging the intermediate sections on either side of the central section, the end sections having the same constant cross-section over their entire respective lengths, said cross-section of the end sections being different from the cross-sections of the central section and of the intermediate sections, where each end section has a first released length and a second released length respectively smaller than the first released length and the second released length of the intermediate sections.

Thus, these end sections are located at two opposite ends of the silicone-made band, and they serve to terminate the lacing with the closure loop of the shoelace which will be made by looping these two end sections. These end sections have elastic returns stronger (in other words more rapid) than the intermediate sections, for a tightening of the shoelace at the top portion which guarantees an enhanced holding.

In this manner, this band has five successive sections and offers three distinct elasticity areas to the shoelace, with a lower area (the central section), an intermediate area (the intermediate sections) and an upper area at the top portion of the shoelace (the end sections).

According to one feature, each end section has a first released length comprised between 5.6 and 6.0 centimeters and a second released length comprised between 5.0 and 5.1 centimeters.

According to another feature, the end section has a substantially circular cross-section with a given diameter, said diameter being smaller than the major axis of the substantially ellipsoidal cross-section of the central section.

In a particular embodiment, the ratio between the length of the end section and the length of a central section is comprised between 0.8 and 1.25.

According to another possibility, the central section has a first released length comprised between 5.9 and 6.3 centimeters and a second released length comprised between 5.1 and 5.3 centimeters, and each intermediate section has a first released length comprised between 5.6 and 6.0 centimeters and a second released length comprised between 5.0 and 5.1 centimeters.

These values also meet the expectations in terms of holding and comfort, though without compressing the foot.

According to another possibility, the central section has a substantially rectangular cross-section having a long-side edge and a short-side edge, and each intermediate section has a substantially circular cross-section with a given diameter, said diameter being smaller than said long-side edge.

Such a geometric shaping also allows meeting the aforementioned requirements in terms of elastic return, namely a central section having an elastic return weaker than the two intermediate sections.

Advantageously, the silicone material of the band has a Shore hardness A comprised between 50 and 90, and preferably a Shore hardness A comprised between 65 and 75.

This choice of hardness is particularly well adapted from the point of view of elastic return considering the dimensions of the band for a conventional shoelace, in order to meet the previously described requirements regarding the elastic return properties.

The invention also relates to a shoe equipped with a shoelace in accordance with the invention, such a shoelace being laced on the shoe by passing though lacing eyelets or hooks.

BRIEF DESCRIPTION OF THE DRAWINGS

Other features and advantages of the present invention will appear upon reading the detailed description hereinafter, of two non-restrictive embodiments, made with reference to the appended figures in which:

FIG. 1 is a schematic perspective view of a shoe equipped with a first shoelace in accordance with the invention;

FIG. 2 is a schematic perspective view of the first shoelace of FIG. 1;

FIG. 3 is a schematic view of a cross-section of the first shoelace of FIGS. 1 and 2;

DETAILED DESCRIPTION

Figure 4:
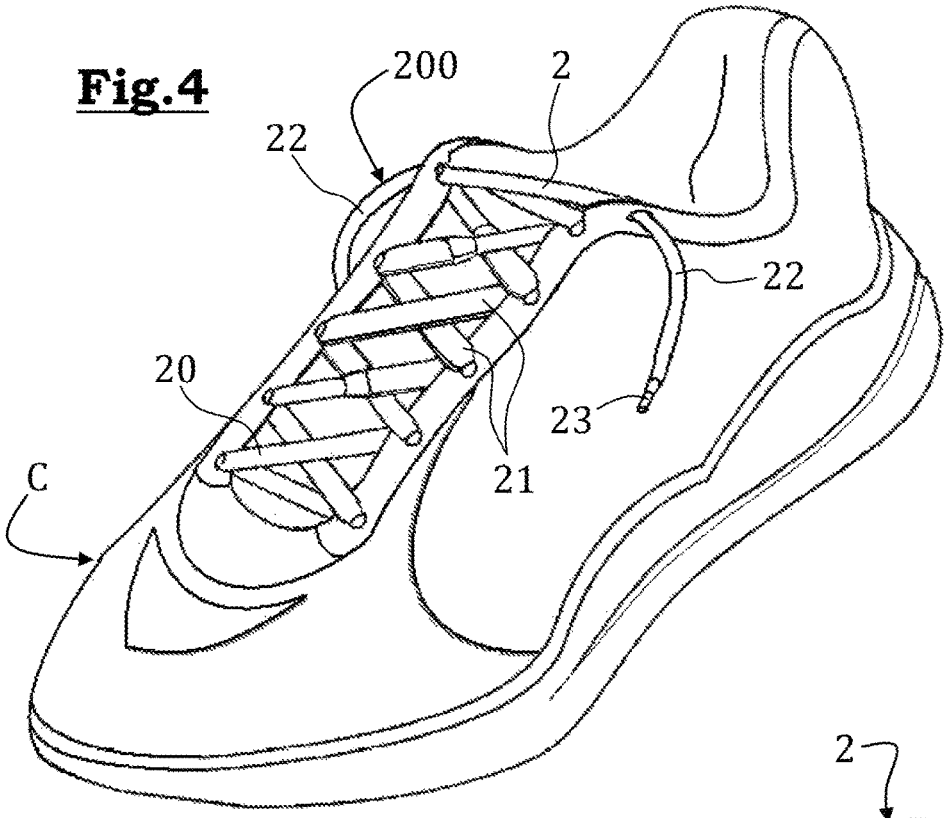
FIG. 4 is a schematic perspective view of a shoe equipped with a second shoelace in accordance with the invention.

With reference to FIG. 1, a shoe C is equipped with a first shoelace 100 in accordance with the invention, this first shoelace 100 being constituted by a band 1 illustrated in FIG. 2.

This elongate elastic band 1 is entirely made of silicone, and has a constant cross-section over substantially its entire length. This band 1 has a total length comprised between 700 millimeters and 1500 millimeters, in particular between 900 and 1200 millimeters.

With reference to FIG. 3, the cross-section of this band 1 is substantially rectangular and has a long-side edge GC, comprised between 5 and 12 millimeters, and a short-side edge PC, comprised between 2 and 4 millimeters.

This band 1 may be obtained by injection of a silicone material, or even by molding.

Optionally, the ends 10 of the band 1 are beveled, in order to facilitate the passage through the lacing orifices provided on the shoe C.

Figure 5:
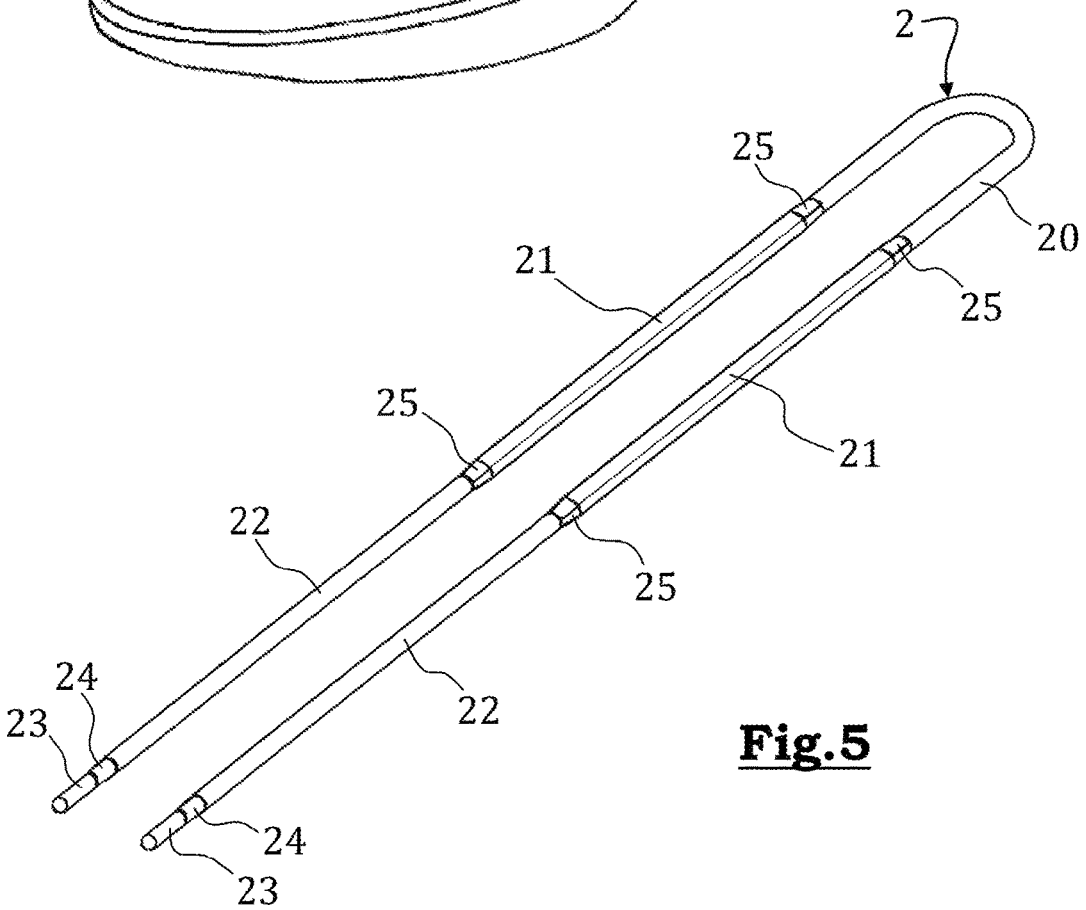
FIG. 5 is a schematic perspective view of the second shoelace of FIG. 4.
Figure 6:
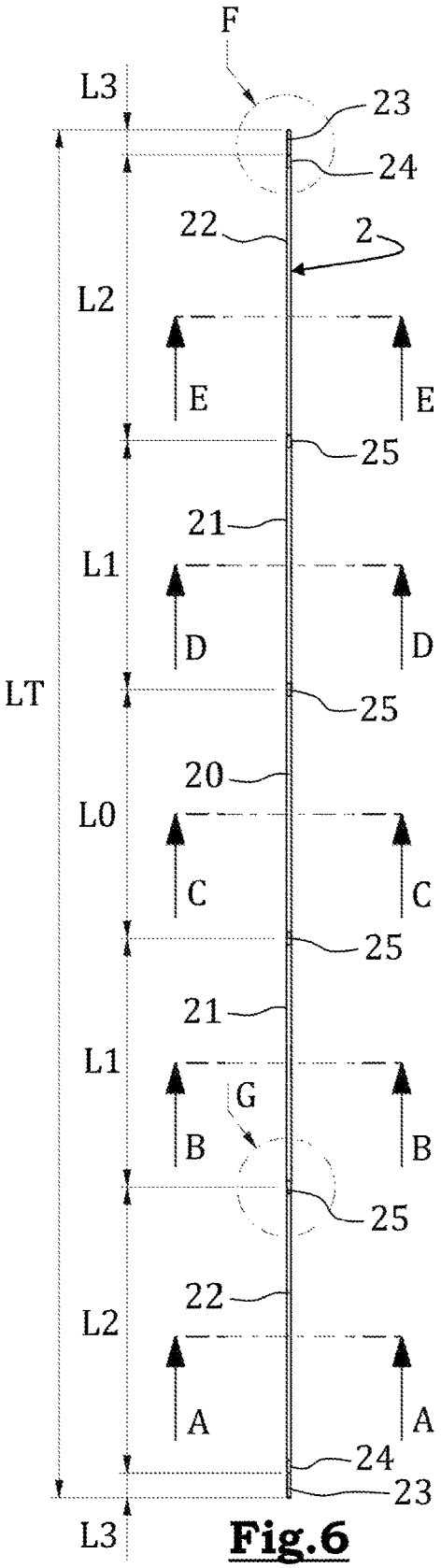
FIG. 6 is a schematic side view of the second shoelace of FIGS. 4 and 5.

With reference to FIG. 4, a shoe C is equipped with a second shoelace 200 in accordance with the invention, this second shoelace 200 being constituted by a band 2 illustrated in FIGS. 5 and 6.

This elongate elastic band 2 is entirely made of silicone, and has at least five successive elongate sections comprising:

- a section called central section 20;
- two sections called intermediate sections 21 which surround the central section 20, in other words extending on either side (to the right and to the left) of the central section 20; and
- two sections called end sections 22 which prolong the intermediate sections 21 on either side of the central section 20.

Thus, the band 2 successively presents, from the right to the left or vice versa, a first end section 22, followed by a first intermediate section 21, followed by the central section 20, followed by a second intermediate section 21, followed by a second end section 22. This band 2 may be obtained by molding of a silicone material.

The total length LT of this band 2 is comprised between 700 millimeters and 1500 millimeters, in particular between 900 and 1200 millimeters.

Figure 7A:
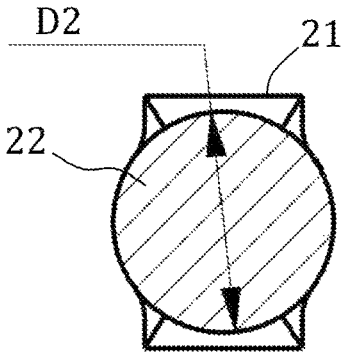
FIG. 7A is a schematic view of a cross-section of the second shoelace of FIGS. 4 to 6, according to the sectional plane A-A visible in FIG. 6 cutting the second shoelace in a first end section.
Figure 7B:
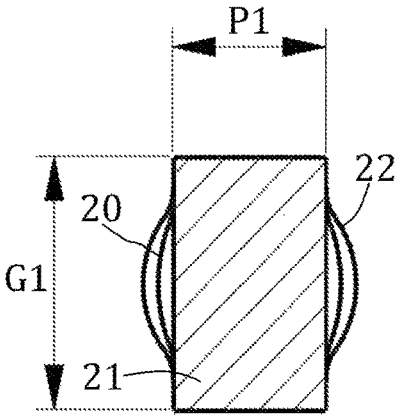
FIG. 7B is a schematic view of a cross-section of the second shoelace of FIGS. 4 to 6, according to the sectional plane B-B visible in FIG. 6 cutting the second shoelace in a first intermediate section.
Figure 7C:
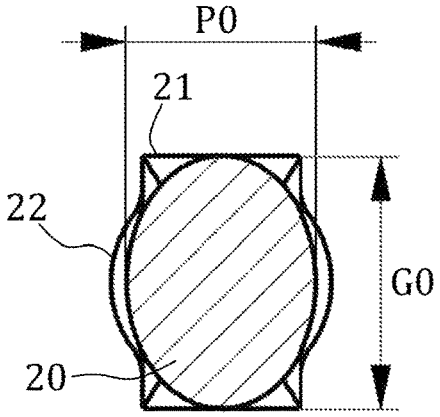
FIG. 7C is a schematic view of a cross-section of the second shoelace of FIGS. 4 to 6, according to the sectional plane C-C visible in FIG. 6 cutting the second shoelace in the central section.

The central section 20 has:

- a length L0 comprised between 160 and 240 millimeters, and in particular between 180 and 220 millimeters; and
- a constant cross-section (visible in FIG. 7C) over its entire length L0, this cross-section being substantially ellipsoidal and having a major axis G0 and a minor axis P0.

The major axis G0 is comprised between 3.5 and 7.0 millimeters, and in particular between 4.0 and 5.0 millimeters, and the minor axis P0 is comprised between 2.5 and 3.5 millimeters, and in particular between 3.0 and 3.5 millimeters.

Figure 7D:
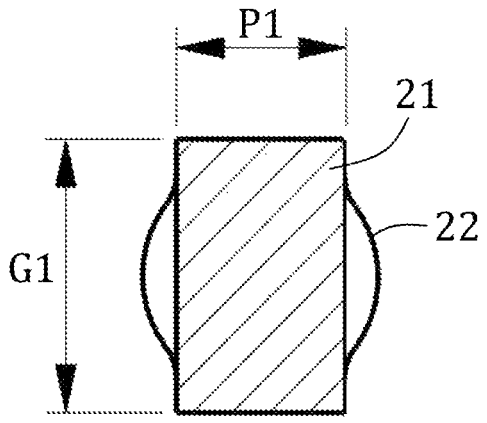
FIG. 7D is a schematic view of a cross-section of the second shoelace of FIGS. 4 to 6, according to the sectional plane D-D visible in FIG. 6 cutting the second shoelace in a second intermediate section.

The two intermediate sections 21 have:

- the same length L1 comprised between 160 and 240 millimeters, and in particular between 180 and 220 millimeters;
- the same cross-section (visible in FIGS. 7B and 7D) constant over their entire respective lengths L1, this cross-section being substantially rectangular and having a long-side edge G1 parallel to the major axis G0 and a short-side edge P1 parallel to the minor axis P0.

The long-side edge G1 is comprised between 3.5 and 7.0 millimeters, and in particular between 4.0 and 5.0 millimeters, and the short-side edge P1 is comprised between 1.5 and 3.0 millimeters, and in particular between 2.0 and 2.5 millimeters; the long-side edge G1 being substantially equivalent, or even equal, to the major axis G0, and the short-side edge P1 being smaller than the minor axis P0.

In the example given hereinabove, the length L1 of an intermediate section 21 is equivalent to the length L0 of the central section 20, but it is possible that these lengths are different. In general, it is possible that the ratio between the length L0 and the length L1 is comprised between 0.8 and 1.25.

Figure 7E:
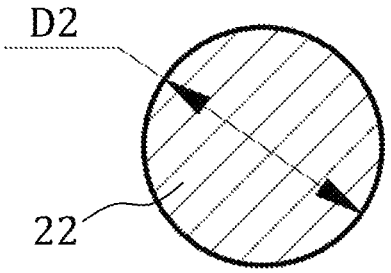
FIG. 7E is a schematic view of a cross-section of the second shoelace of FIGS. 4 to 6, according to the sectional plane E-E visible in FIG. 6 cutting the second shoelace in a second end section.

The two end sections 22 have:

- the same length L2 comprised between 180 and 270 millimeters, and in particular between 200 and 250 millimeters;
- the same cross-section (visible in FIGS. 7A and 7E) constant over their entire respective lengths L2, this cross-section being substantially circular with a diameter D2.

The diameter D2 is smaller than the major axis G0 and is comprised between 3.0 and 5.0 millimeters, in particular between 3.5 and 4.5 millimeters.

In the example given hereinabove, the length L2 of an end section 22 is greater than the length L0 of the central section 20, but it is possible to consider that these lengths are equivalent. In general, it is possible to consider that the ratio between the length L0 and the length L2 is comprised between 0.8 and 1.25.

It should also be noted that the central section 20 does not have the same cross-section as the two intermediate sections 21 and as the two end sections 22, and the two intermediate sections 21 do not have the same cross-section as the two end sections 22.

Figure 8:
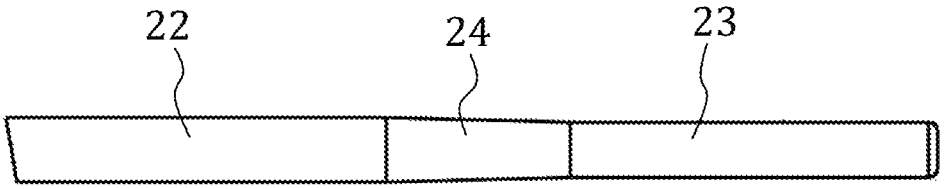
FIG. 8 is an enlarged schematic view of the area F of FIG. 6.
Figure 9:
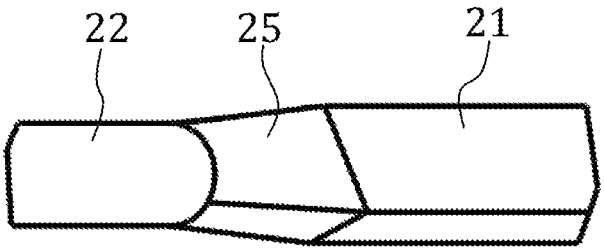
FIG. 9 is an enlarged schematic perspective view of the area G of FIG. 6.

As is visible in FIG. 8, each end section 22 may be prolonged by a ending 23 with a cylindrical section, the diameter of which, in particular comprised between 2.5 and 3.0 millimeters, is smaller than the diameter D2 of the end section 22, and the length L3 of which is comprised between 10 and 30 millimeters, in particular about 20 millimeters; a truncated-cone shaped portion 24 extending between the end section 22 and the ending 23 so as to ensure a regular reduction of diameter. The ending 23 is intended to facilitate the passage through the lacing orifices provided on the shoe C.

Pyramidal portions 25 are also provided between the intermediate sections 21 and, at one side, the central section 20 and, at the other side, the corresponding end section 22, thereby reinforcing the interfacing areas between the intermediate sections 21 and the adjacent sections 20, 22.

The following description relates to the elastic return properties of the two silicone-made bands 1, 2.

In particular, it is advantageous for the invention that the used silicone material has the following characteristics:

- a Shore hardness A (according to standard NF ISO 7619-1) comprised between 65 and 75;
- a tensile breakage strength (according to standard NF ISO 37) comprised between 7 and 9 MPa, and preferably 80;
- a tensile breakage elongation (according to standard NF ISO 37) comprised between 400 and 600%, and preferably 500%;
- a type C tear strength (according to standard NF ISO 34-1) comprised between 30 and 40 kN/m, and preferably 35 kN/m; and
- a density (according to standard NF ISO 2781) comprised between 1.14 and 1.24, and preferably between 1.18 and 1.20.

Figure 10A:
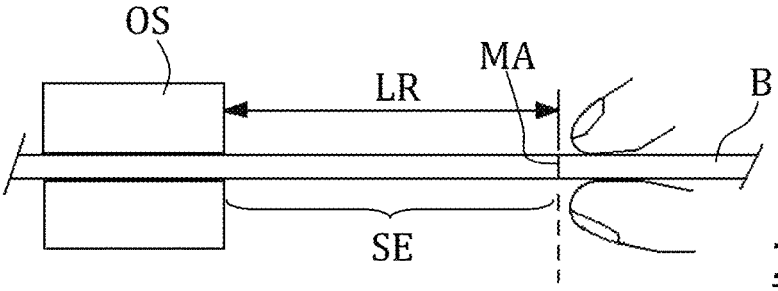
FIGS. 10A to 10D illustrate the steps of measurement of the elastic return properties performed on a shoelace segment.
Figure 10B:
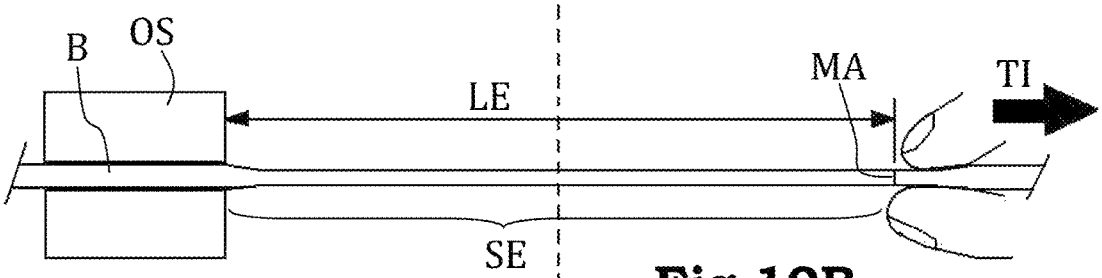
Figure 10C:
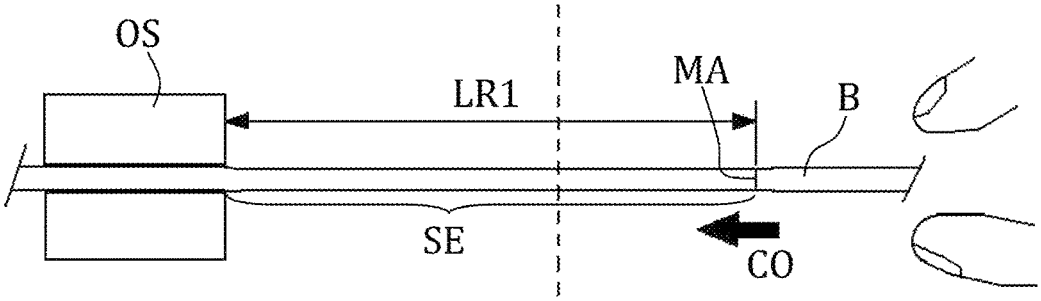
Figure 10D:
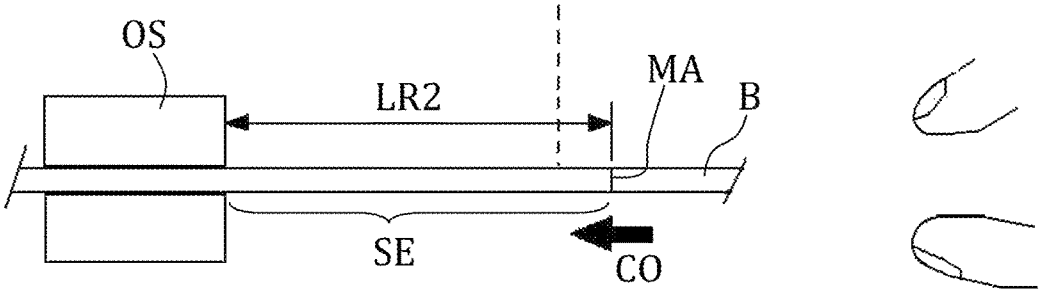

With reference to FIGS. 10A to 10D, in order to characterize the elastic return properties of a band B (whether it is the band 1 or the band 2), a measurement test is implemented, and which consists in:

- as illustrated in FIG. 10A, selecting a segment SE of the considered band B, where the segment SE has a constant cross-section and a length at rest LR of 5.0 centimeters (it is thus possible to select a segment on the band 1, or a segment of the central section 20 of the band 2, or a segment of any of the intermediate sections 21 of the band 2, or a segment of any of the end sections 22 of the band 2);
- as illustrated in FIG. 10A, clamping a side of the segment SE by means of a clamping tool OS, such as a vise or a jaw, and placing a mark MA at 5.0 centimeters, the segment SE being at rest;
- as illustrated in FIG. 10B, grasping manually or by means of a tool the other side of the segment SE, just behind the mark MA, and stretching this segment SE by pulling on (as drawn by the arrow TI) at a stretching speed comprised between 1.2 and 1.6 centimeters per second, until reaching a stretched length LE of 10.0 centimeters;
- as illustrated in FIG. 10C, at the instant t0 releasing the segment SE which then contracts (as drawn by the arrow CO) and, at the instant t0+t1 (t1=first time after release) measuring the length LR1 of the segment SE, called first released length;
- as illustrated in FIG. 10D, at the instant t0+t2 (t2=second time after release, where t2>t1) measuring the length LR2 of the segment SE, called second released length.

As example, the first time t1 is comprised between 0.1 and 1 second, and the second time t2 is comprised between 15 and 25 seconds.

In the tests carried out with the bands 1, 2, t1 is set to 1 second and t2 is set to 22 seconds.

As regards the first shoelace 100, the band 1 has a first released length LR1 comprised between 6.6 and 7.0 centimeters, and a second released length LR2 comprised between 5.3 and 5.7 centimeters.

As regards the second shoelace 200, the geometric and dimensional differences of their cross-sections between the sections 20, 21, 22 of the band 2 is reflected in differences of the elastic return properties wherein:

- the central section 20 has a first released length LR1 comprised between 6.2 and 6.6 centimeters and a second released length LR2 comprised between 5.4 and 5.6 centimeters;
- each intermediate section 21 has a first released length comprised between 5.9 and 6.3 centimeters and a second released length comprised between 5.1 and 5.3 centimeters;
- each end section 22 has a first released length LR1 comprised between 5.6 and 6.0 centimeters and a second released length LR2 comprised between 5.0 and 5.1 centimeters.

In general, the band 2 is shaped so that the central section 20 has a first released length LR1 and a second released length LR2 respectively greater than the first released length LR1 and the second released length LR2 of the intermediate sections 21, and each end section 22 has a first released length LR1 and a second released length LR2 respectively smaller than the first released length LR1 and the second released length LR2 of the intermediate sections 21.

In other words, the central section 20 has the greatest released lengths, whereas the end sections 22 have the smallest released lengths, the intermediate sections 21 having intermediate released lengths.

As is visible in FIG. 4, when in place on the shoe C, once laced, the central section 20 is positioned at the start (or at the bottom) of the lacing area, then the two intermediate sections 21 continue the lacing at the instep, and finally the end sections 22 terminate the lacing at the top portion of the instep (at the ankle) and serve to form the closure loop of the shoelace 200.

Thus, each section 20, 21, 22 has its own elasticity to confer optimum comfort and holding, though without compressing the foot, even after swelling, where the central section 10 (the most firm) allows tightening the shoelace firmly at the toes, the intermediate sections 21 for a stable lacing without tension at the instep in order to offer a good vein return and a good holding, and the end sections 22 (more flexible) for a firm but non-compressive tightening at the ankle.

Of course, the implementation examples mentioned hereinabove are not restrictive and other improvements and details may be added to the shoelace according to the invention, without departing from the scope of the invention where for example other shapes of the cross-sections and/or other dimensions may be considered for example.

As example, it is possible to consider having a band with three sections, rather than five sections, comprising:

a central section whose shape and dimensions of the cross-section, and therefore the elastic properties, are similar to those of the previously described intermediate section 21; and two end sections with the same lengths and whose shapes and dimensions of the cross-section, and therefore the elastic properties, are similar to those of the previously described end sections 22, these end sections surrounding the central section.

In this embodiment with three sections (without counting the possible endings 23 and/or pyramidal portions 25), the ratio between the length of the central section and the length of an end section is comprised between 2.4 and 3.75.

The invention claimed is:

1. A shoelace for a shoe, formed of a band without envelope or sheath around the band, wherein said band is an elongate elastic band entirely made of silicone, said band having elastic properties according to which, by selecting at least one segment in a section of said band, said segment having a constant cross-section and a length at rest of 5.0 centimeters, when said segment is stretched until reaching a stretched length of 10.0 centimeters and then released, said segment contracts and reaches a first released length comprised between 5.6 and 7.0 centimeters after a first time comprised between 0.1 and 1 second after the release, and reaches a second released length comprised between 5.0 and 5.6 centimeters after a second time comprised between 15 and 25 seconds after the release, wherein said first released length and said second released length are associated to said section.

2. The shoelace according to claim 1, wherein the band has a main section having a constant cross-section over at least 95% of the length of the band.

3. The shoelace according to claim 2, wherein the main section has a constant cross-section over the entire length of the band.

4. The shoelace according to claim 2, wherein the main section has its first released length comprised between 6.6 and 7.0 centimeters, and its second released length comprised between 5.3 and 5.6 centimeters.

5. The shoelace according to claim 1, wherein the band has at least three successive elongate sections comprising a central section surrounded by two intermediate sections with the same lengths, the intermediate sections having the same constant cross-section over their entire respective lengths, and the central section having a cross-section constant over its entire length and different from that of the intermediate sections, wherein the central section has its first released length and its second released length greater than respectively the first released length and the second released length of the intermediate sections.

6. The shoelace according to claim 5, wherein the central section has its first released length comprised between 6.2 and 6.6 centimeters and its second released length comprised between 5.4 and 5.6 centimeters, and each intermediate section has its first released length comprised between 5.9 and 6.3 centimeters and its second released length comprised between 5.1 and 5.3 centimeters.

7. The shoelace according to claim 5, wherein the central section has an ellipsoidal cross-section having a major axis and a minor axis, and each intermediate section has a rectangular cross-section having a long-side edge parallel to said major axis and a short-side edge parallel to said minor axis, wherein said minor axis is larger than said short-side edge and said major axis is equivalent to said long-side edge.

8. The shoelace according to claim 5, wherein a ratio between the length of the central section and the length of an intermediate section is comprised between 0.8 and 1.25.

9. The shoelace according to claim 5, wherein the band has two end sections with the same lengths and prolonging the intermediate sections on either side of the central section, the end sections having the same constant cross-section over their entire respective lengths, said cross-section of the end sections being different from the sections of the central section and of the intermediate sections, wherein each end section has its first released length and its second released length respectively smaller than the first released length and the second released length of the intermediate sections.

10. The shoelace according to claim 9, wherein each end section has its first released length comprised between 5.6 and 6.0 centimeters and its second released length comprised between 5.0 and 5.1 centimeters.

11. The shoelace according to claim 7, wherein the end section has a circular cross-section with a given diameter, said diameter being smaller than the major axis of the ellipsoidal cross-section of the central section.

12. The shoelace according to claim 9, wherein a ratio between the length of the end section and the length of a central section is comprised between 0.8 and 1.25.

13. The shoelace according to claim 5, wherein the central section has its first released length comprised between 5.9 and 6.3 centimeters and its second released length comprised between 5.1 and 5.3 centimeters, and each intermediate section has its first released length comprised between 5.6 and 6.0 centimeters and its second released length comprised between 5.0 and 5.1 centimeters.

14. The shoelace according to claim 5, wherein the central section has a rectangular cross-section having a long-side edge and a short-side edge, and each intermediate section has a circular cross-section with a given diameter, said diameter being smaller than said long-side edge.

15. The shoelace according to claim 13, wherein the ratio between the length of the central section and the length of an end section is comprised between 2.4 and 3.75.

16. The shoelace according to claim 14, wherein the ratio between the length of the central section and the length of an end section is comprised between 2.4 and 3.75.

17. The shoelace according to claim 1, wherein the silicone material of the band has a Shore hardness A comprised between 50 and 90.

18. The shoelace according to claim 17, wherein the silicone material of the band has a Shore hardness A comprised between 65 and 75.

19. A shoe equipped with a shoelace according to claim 1.

* * * * *